US010138628B2

(12) United States Patent
Sollie et al.

(10) Patent No.: US 10,138,628 B2
(45) Date of Patent: Nov. 27, 2018

(54) INSULATION BATT

(71) Applicant: Pratt Corrugated Holdings, Inc., Conyers, GA (US)

(72) Inventors: Greg Sollie, Sharpsburg, GA (US); William Grosskopf, Greenville, SC (US); Jorge Paez, Auburn, AL (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 15/892,907

(22) Filed: Feb. 9, 2018

(65) Prior Publication Data

US 2018/0163395 A1 Jun. 14, 2018

Related U.S. Application Data

(62) Division of application No. 15/239,305, filed on Aug. 17, 2016, now Pat. No. 9,920,517.

(51) Int. Cl.

| | |
|---|---|
| ***E04B 1/74*** | (2006.01) |
| ***E04B 1/76*** | (2006.01) |
| ***E04B 1/80*** | (2006.01) |

(52) U.S. Cl.

CPC ..... *E04B 1/767* (2013.01); *E04B 1/7608* (2013.01); *E04B 1/7654* (2013.01); *E04B 1/80* (2013.01)

(58) Field of Classification Search

CPC ..... E04B 1/767; E04B 1/7608; E04B 1/7654; E04B 1/80; E04B 1/78; E04B 1/7662; Y10T 428/237

See application file for complete search history.

(56) References Cited

U.S. PATENT DOCUMENTS

| | | | |
|---|---|---|---|
| 3,729,879 | A | 5/1973 | Franklin |
| 5,152,018 | A | 10/1992 | Lea |
| 5,331,787 | A | 7/1994 | Paulitschke et al. |
| 5,350,063 | A | 9/1994 | Berdan, II |
| 5,486,401 | A | 1/1996 | Grant |
| 5,498,458 | A | 3/1996 | Kleinke |
| 5,516,580 | A | 5/1996 | Frenette et al. |

(Continued)

FOREIGN PATENT DOCUMENTS

| | | |
|---|---|---|
| WO | 2015044756 | 4/2015 |
| WO | 2015135656 | 9/2015 |

OTHER PUBLICATIONS

Sollie, Greg; Advisory Action for U.S. Appl. No. 15/239,305, filed Aug. 17, 2016, dated Aug. 23, 2017, 5 pgs.

(Continued)

*Primary Examiner* — Brian D Mattei

(74) *Attorney, Agent, or Firm* — Taylor English Duma LLP

(57) ABSTRACT

A method of installing an insulation batt can include expanding an insulation layer of insulation batt between a first stiffening layer and a second stiffening layer of the insulation batt; and placing the insulation batt in an insulation cavity. A connector can couple the first stiffening layer to the second stiffening layer. The connector can include a first elongated connection panel and a second elongated connection panel, and expanding the insulation can include folding the first elongated connection panel relative to the first stiffening layer and folding the second elongated connection panel relative to the second stiffening layer. The method can further include engaging a mounting tab of the insulation batt with a wall of the insulation cavity to position the insulation batt in the insulation cavity.

20 Claims, 10 Drawing Sheets

(56) References Cited

U.S. PATENT DOCUMENTS

| | | | |
|---|---|---|---|
| 5,545,453 | A | 8/1996 | Grant |
| 5,554,238 | A | 9/1996 | English |
| 5,556,682 | A | 9/1996 | Gavin et al. |
| 5,765,318 | A | 6/1998 | Michelsen |
| 5,766,721 | A | 6/1998 | Bussey et al. |
| 5,832,696 | A | 11/1998 | Nagy et al. |
| 5,848,509 | A | 12/1998 | Knapp et al. |
| 5,918,436 | A | 7/1999 | Alderman |
| 5,981,037 | A | 11/1999 | Patel et al. |
| 6,042,911 | A | 3/2000 | Berdan, II |
| 6,120,873 | A | 9/2000 | Grant |
| 6,123,172 | A | 9/2000 | Byrd et al. |
| 6,191,057 | B1 | 2/2001 | Patel et al. |
| 6,308,491 | B1 | 10/2001 | Porter |
| 6,357,504 | B1 | 3/2002 | Patel et al. |
| 6,579,586 | B1 | 6/2003 | Fay |
| 6,797,356 | B2 | 9/2004 | Zupon |
| 6,815,380 | B2 | 11/2004 | Snyder |
| D523,744 | S | 6/2006 | Zeng |
| 7,097,911 | B2 | 8/2006 | Arthurs et al. |
| 7,381,456 | B2 | 6/2008 | Fay et al. |
| 7,476,427 | B2 | 1/2009 | Ruid et al. |
| 7,785,685 | B2 | 8/2010 | Fay |
| 7,857,923 | B2 | 12/2010 | Suda et al. |
| 7,913,842 | B2 | 3/2011 | Evans |
| 8,209,930 | B2 | 7/2012 | Babbitt |
| 8,333,279 | B2 | 12/2012 | Veiseh |
| 8,424,262 | B2 | 4/2013 | Deblander et al. |
| 9,216,560 | B2 | 12/2015 | Crostic, Jr. |
| 9,920,517 | B2 | 3/2018 | Sollie |
| 2003/0008093 | A1 | 1/2003 | Ray |
| 2004/0185225 | A1 | 9/2004 | Fay |
| 2005/0249910 | A1 | 11/2005 | Campal et al. |
| 2006/0078699 | A1 | 4/2006 | Mankell et al. |
| 2007/0015424 | A1 | 1/2007 | Toas et al. |
| 2007/0122584 | A1 | 5/2007 | Song et al. |
| 2008/0220679 | A1 | 9/2008 | Berdan |
| 2009/0293396 | A1 | 12/2009 | Porter |
| 2010/0065206 | A1 | 3/2010 | Romes |
| 2010/0146896 | A1 | 6/2010 | Peeters |
| 2013/0094791 | A1 | 4/2013 | Aspenson et al. |
| 2014/0037905 | A1 | 2/2014 | Cerutti |
| 2018/0051460 | A1 | 2/2018 | Sollie et al. |

OTHER PUBLICATIONS

Sollie, Greg; Applicant-Initiated Interview Summary for U.S. Appl. No. 15/239,305, filed Aug. 17, 2016, dated Jul. 6, 2017, 2 pgs.

Sollie, Greg; Final Office Action for U.S. Appl. No. 15/239,305, filed Aug. 17, 2016, dated Jun. 15, 2017, 9 pgs.

Sollie, Greg; Issue Notification for U.S. Appl. No. 15/239,305, filed Aug. 17, 2016, dated Feb. 28, 2018, 1 pg.

Sollie, Greg; Non-Final Office Action for U.S. Appl. No. 15/239,305, filed Aug. 17, 2016, dated Sep. 20, 2017, 9 pgs.

Sollie, Greg; Non-final Office Action for U.S. Appl. No. 15/239,305, filed Aug. 17, 2016, dated Apr. 3, 2017, 20 pgs.

Sollie, Greg; Notice of Allowance for U.S. Appl. No. 15/239,305, filed Aug. 17, 2016, dated Nov. 1, 2017, 5 pgs.

INSULATION BATT

REFERENCE TO RELATED APPLICATIONS

This application is a divisional of U.S. application Ser. No. 15/239,305, filed Aug. 17, 2016, which is hereby specifically incorporated by reference herein in its entirety.

TECHNICAL FIELD

This disclosure relates generally to insulation. More specifically, this disclosure relates to compressible and expandable insulation batts.

BACKGROUND

A typical residential house can be built with a wooden frame forming walls covered on an exterior of the house with wooden panels, such as plywood boards, which can then be covered with, for example, brick or siding to form the exterior of the house. The wooden frame typically comprises a plurality of wooden boards such as "two-by-fours" (also referred to as a 2×4s). A standard two-by-four defines a rectangular cross-section measuring 1.5 (1 and ½) inches by 3.5 (3 and ½) inches. The two-by-fours typically forming the walls of the house are commonly spaced apart at standard lengths, such as 16 inches on center with the 3.5-inch sides of the two-by-fours facing each other. In this arrangement, the two-by-fours define a cavity therebetween measuring 14.5 (14 and ½) inches wide and 3.5 (3 and ½) inches deep. The height of the cavity varies with the size of the rooms defined by the walls, but a typical eight-foot ceiling forms a cavity measuring 92.625 (92 and ⅝) inches long.

The cavities defined by the wooden frame are typically filled with insulation products at least on exterior walls of the house to prevent heat from entering or exiting through the exterior walls of the house between the two-by-fours. Typical insulation products can comprise fiberglass, such as glass wool, provided in a roll or as precut "batts" sized to fit in the cavity. This insulation is easily compressible but difficult to expand. Compressed insulation has a lower R-value, which is a measure of a material's thermal resistance. For example, one inch of compression of standard fiberglass insulation can reduce the R-value by as much as 25%. A higher R-value provides better insulating properties, preventing more heat from transferring through the material. The insulation can also be installed too loosely in the cavity, allowing it to collapse, sag, or fall downward within the cavity, or even can be difficult to install in the cavity in the first place due to the lack of rigidity of the insulation.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is an insulation batt comprising a first stiffening layer; an insulation layer coupled to the first stiffening layer on a first side of the insulation layer; a second stiffening layer coupled to a second side of the insulation layer distal from the first stiffening layer; and a connector coupling the first stiffening layer to the second stiffening layer, the insulation layer configured to compress between the first stiffening layer and the second stiffening layer when the first stiffening layer and the second stiffening layer are pushed together, and the insulation layer configured to expand between the first stiffening layer and the second stiffening layer when the first stiffening layer and the second stiffening layer are pulled apart.

Also disclosed is a method of installing an insulation batt comprising expanding an insulation layer of insulation batt between a first stiffening layer and a second stiffening layer of the insulation batt; and placing the insulation batt in an insulation cavity.

Also disclosed is a method of assembling an insulation batt comprising coupling a first stiffening layer to an insulation layer; coupling a second stiffening layer to the insulation layer; and compressing the insulation layer between the first stiffening layer and the second stiffening layer.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
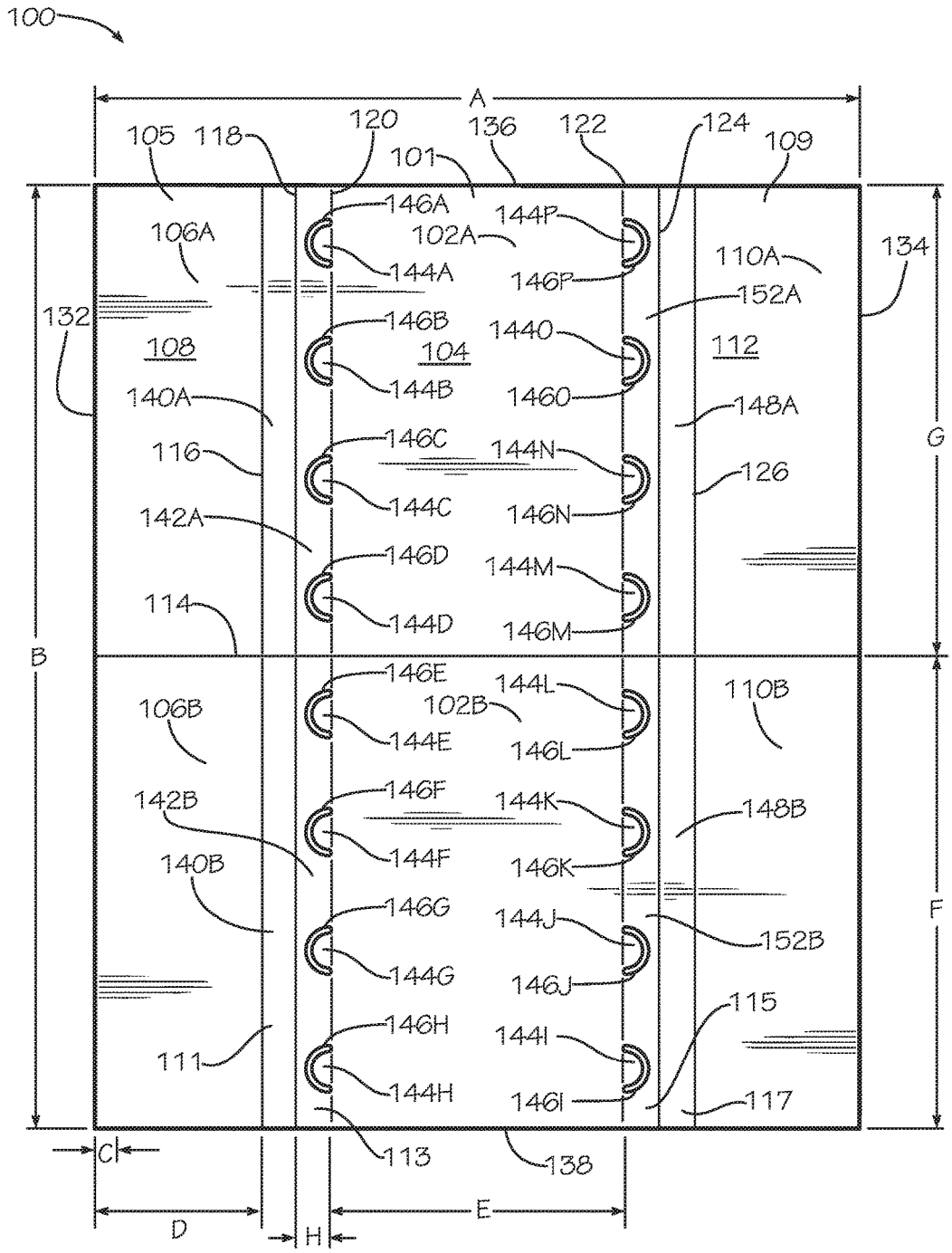
FIG. 1 is a front view of a blank of an insulation cover in accordance with one aspect of the current disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "a resistor" can include two or more such resistors unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

In one aspect, disclosed is an insulation batt and associated methods, systems, devices, and various apparatus. The insulation batt comprises a first and second stiffening layer and an insulation layer therebetween. It would be understood by one of skill in the art that the disclosed insulation batt is described in but a few exemplary aspects among many. No particular terminology or description should be considered limiting on the disclosure or the scope of any claims issuing therefrom.

One aspect of a blank 100 for use with an insulation batt 200 (shown in FIG. 2) is disclosed and described in FIG. 1. The blank 100 comprises a front panel 101, a first back panel 105, and a second back panel 109. The front panel 101 defines an outer surface 104, the first back panel 105 defines an outer surface 108, and the second back panel 109 defines an outer surface 112. The first back panel 105 defines a left edge 132 of the blank 100 and the second back panel 109 defines a right edge 134 of the blank 100.

The blank 100 further comprises a first elongated connection panel 111 and a second elongated connection panel 113 between the first back panel 105 and the front panel 101. The blank 100 further comprises a third elongated connection panel 115 and a fourth elongated connection panel 117 between the front panel 101 and the second back panel 109. The front panel 101, first back panel 105, second back panel 109, and each elongated connection panel 111, 113, 115, 117 can thereby be integrally connected to each other as a single blank 100. The first back panel 105 and the first elongated connection panel 111 are connected at a first lengthwise crease 116. In the current aspect, "lengthwise" can be defined in a direction defined by a length B of the blank 100. The first elongated connection panel 111 and the second elongated connection panel 113 are connected at a second lengthwise crease 118. The second elongated connection panel 113 and the front panel 101 are connected at a third lengthwise crease 120. The front panel 101 and the third elongated connection panel 115 are connected at a fourth lengthwise crease 122. The third elongated connection panel 115 and the fourth elongated connection panel 117 are connected at a fifth lengthwise crease 124. The fourth elongated connection panel 117 and the second back panel 109 are connected by a sixth lengthwise crease 126.

In combination, the first back panel 105, the first elongated connection panel 111, the second elongated connection panel 113, the front panel 101, the third elongated connection panel 115, the fourth elongated connection panel 117, and the second back panel 109 can define an upper edge 136 and a lower edge 138 of the blank 100.

The blank 100 further can define a lateral crease 114 dividing the blank 100 into upper and lower portions. In the current aspect, "lateral" can be defined in a direction defined by a width A of the blank 100. The first back panel 105 defines an upper portion 106A and a lower portion 106B on either side of the lateral crease 114. The first elongated connection panel 111 defines an upper portion 140A and a lower portion 140B on either side of the lateral crease 114. The second elongated connection panel 113 defines an upper portion 142A and a lower portion 142B on either side of the lateral crease 114. The front panel 101 defines an upper portion 102A and a lower portion 102B on either side of the lateral crease 114. The third elongated connection panel 115 defines an upper portion 152A and a lower portion 152B on either side of the lateral crease 114. The fourth elongated connection panel 117 defines an upper portion 148A and a lower portion 148B on either side of the lateral crease 114. The second back panel 109 defines an upper portion 110A and a lower portion 110B on either side of the lateral crease 114.

The blank 100 can define a plurality of mounting tabs 144. In the current aspect, the second elongated connection panel 113 can define eight mounting tabs 144A-H, with four mounting tabs 144A-D above the lateral crease 114 and four mounting tabs 144E-H below the lateral crease 114. In the current aspect, the third elongated connection panel 115 can also define eight mounting tabs I-P, with four mounting tabs 144I-L below the lateral crease 114 and four mounting tabs 144M-P above the lateral crease 114. Each of the mounting tabs 144 can be defined by a slot 146 defined in the blank 100. Mounting tabs 144A-H are defined by slots 146A-H, respectively, defined in the second elongated connection panel 113, and mounting tabs 144I-P are defined by slots 146I-P, respectively defined in the third elongated connection panel 115. In the current aspect, each slot 146 is arcuate, thereby defining semicircular mounting tabs 114. However, in other aspects, the slots 146 and mounting tabs 144 can define other shapes and the disclosure of arcuate slots 146 and semicircular tabs 144 should not be considered limiting on the current disclosure.

The mounting tabs 144 can be defined along any of the lengthwise creases 116, 118, 120, 122, 124, 126. In the current embodiment, the mounting tabs 144 are defined along the lengthwise creases 120, 122. Specifically, in the current aspect, each end of each slot 146A-H terminates at the third lengthwise crease 120 such that each mounting tab 144A-H is defined on the second elongated connection panel 113 along the third lengthwise crease 120. Additionally, in the current aspect, each end of each slot 146I-P terminates at the fourth lengthwise crease 122 such that each mounting tab 144I-P is defined on the third elongated connection panel 115 along the fourth lengthwise crease 122. In various aspects, the lengthwise creases 120, 122 may only extend between adjacent slots 146 without extending along an edge of the mounting tabs 144, such that the second elongate connection panel 113 and the third elongated connection panel 115 can bend relative to the front panel 101 along the third lengthwise crease 120 and the fourth lengthwise crease 122, respectively with each mounting tab 144 remaining parallel to the front panel 101.

As shown in FIG. 1, the blank 100 is rectangular in the current aspect. The blank 100 defines the width A and the length B. The first back panel 105 defines a width D and the front panel 101 defines a width E. The second elongated connection panel 113 defines a width H. In the current aspect, the first elongated connection panel 111, the third elongated connection panel 115, and the fourth elongated connection panel 117 can define widths equal to width H, and the second back panel 109 can define a width equal to width D. In addition, the first back panel 105 can define an overlap width C. The second back panel 109 defines a similar overlap width. As discussed below, when assembled around an insulation layer 202 (shown in FIG. 2), the blank 100 wraps around the insulation layer 202 such that the first back panel 105 and the second back panel 109 can overlap each other at the overlap width C. The lower portions of the blank 100 below the lateral crease 114 can define a lower portion length F, and the upper portions of the blank 100 above the lateral crease 114 can define an upper portion length G.

In the current aspect, for example and without limitation, the width A of the blank can equal about 37.625 (37 and ⅝) inches, the length B of the blank 100 can equal about 46.375 (46 and ⅜) inches, the overlap width C can equal about 1.875 (1 and ⅞) inches, the width D can equal about 8.125 (8 and ⅛) inches, the width E can equal about 14.375 (14 and ⅜) inches, and the width H can equal about 1.75 (1 and ¾) inches. The lower portion length F and the upper portion length G can both equal about 23.1875 (23 and 3/16) inches. However, in other aspects, the widths and length can have dimensions other than those described above, and the disclosed dimensions should not be considered limiting on the current disclosure. In the current aspect, the width E provides the front panel 101 with a width such that the assembled insulation batt 200, in an expanded configuration, can fit between the two-by-fours within a standard insulation cavity in a wooden-frame house, which is approximately 14.5 inches wide, such that the insulation batt 200 has a clearance of approximately 0.125 (⅛) inches. Similarly, in the current aspect, the width H allows the elongated connection panels 111, 113, in combination, to define a depth of the insulation batt 200 such that the assembled insulation batt 200, in the expanded configuration, can fit within the depth of the standard insulation cavity in a wooden-frame house, which is approximately 3.5 inches deep.

Figure 2:
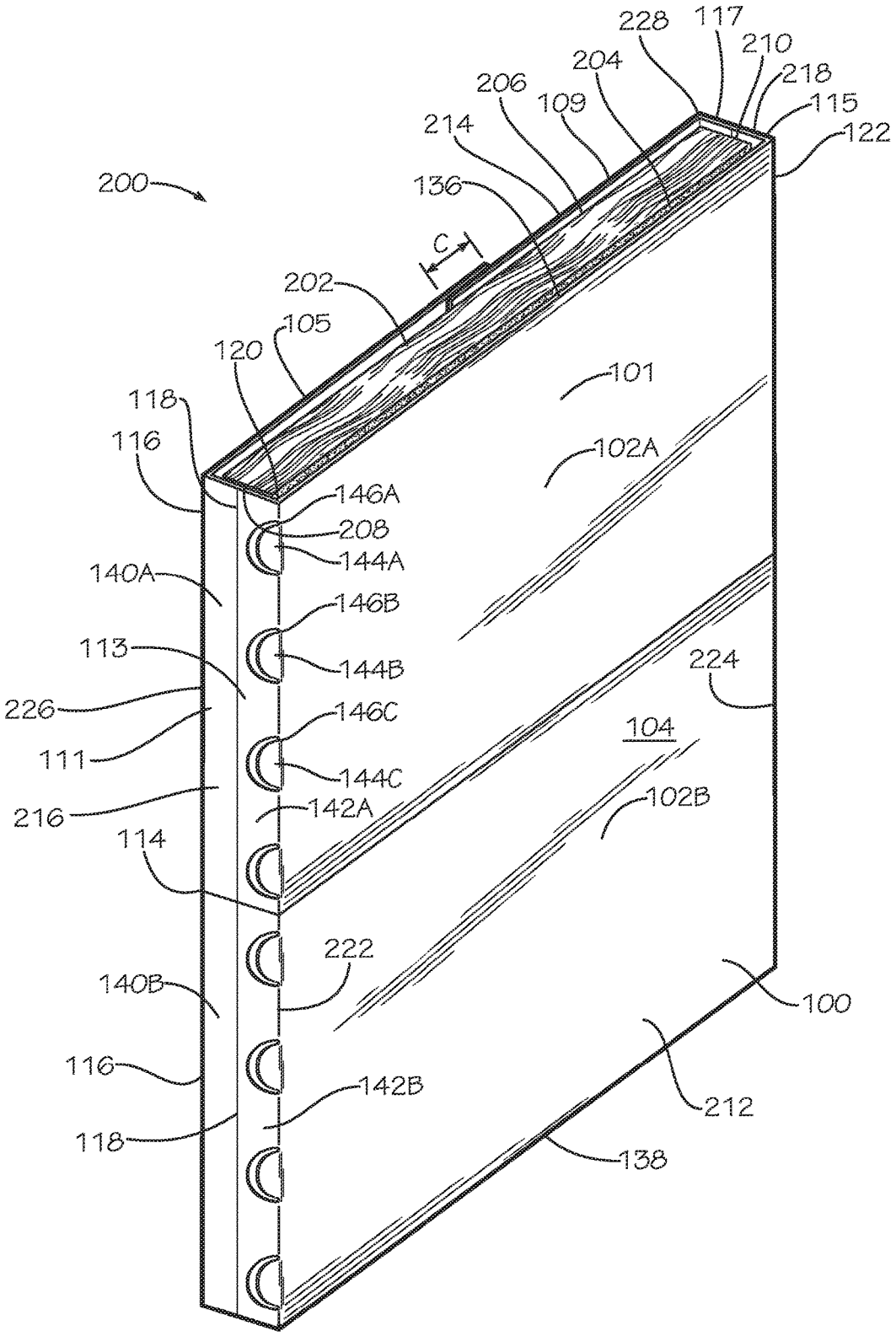
FIG. 2 is a perspective view of an insulation batt, in an expanded configuration, comprising an insulation layer and the insulation cover of FIG. 1.

FIG. 2 shows the assembled insulation batt 200 in an expanded configuration. As shown in FIG. 2, the blank 100 can be wrapped around the insulation layer 202. In the current aspect, the front panel 101 covers a first side 204 of the insulation layer 202, the first back panel 105 and the second back panel 109, in combination, cover a second side 206 of the insulation layer 202, the first elongated connection panel 111 and the second elongated connection panel 113 cover a first lateral edge 208 of the insulation layer 202, and the third elongated connection panel 115 and the fourth elongated connection panel 117 cover a second lateral edge 210 of the insulation layer 202. The first back panel 105 and the second back panel 109 are coupled to each other across the overlap width C. The left edge 132 of the blank 100 is thereby coupled to the right edge 134 of the blank 100 in the current aspect. In one aspect, the first back panel 105 and the second back panel 109 are coupled to each other across the overlap width C by adhesive, though in other aspects the first back panel 105 and the second back panel 109 can be coupled to each other by other mechanisms known in the art, such as tape, clips, or other fasteners.

In the expanded configuration, the insulation layer 202 extends within the insulation batt 200 along the entire length B of the blank 100 and the entire width E of the front panel 101 such that the insulation layer 202 fills the insulation batt 200 in the expanded configuration.

As assembled, the front panel 101 can define a first stiffening layer 212 of the insulation batt 200 coupled to the first side 204 of the insulation layer 202 and the combination of the first back panel 105 and the second back panel 109 can define a second stiffening layer 214 coupled to the second side 206 of the insulation layer 202. In the current aspect, the first stiffening layer 212 can be adhered to the first side 204 of the insulation layer 202 and the second stiffening layer 214 can be adhered to the second side 206 of the insulation layer 206. The stiffening layers 212, 214 can be adhered to the sides 204,206, respectively, of the insulation layer 202, for example and without limitation, by adhesive, double-sided tape, a series of clips, or any other mechanism known in the art for coupling insulation to a non-insulation material. Thus, when in the expanded configuration, the first stiffening layer 212 and the second stiffening layer 214 pull first side 204 and the second side 206, respectively, of the insulation layer 202 apart to expand the insulation layer, thereby increasing the R-value of the insulation layer. In this manner, the insulation layer 202 is configured to expand between the first stiffening layer 212 and the second stiffening layer 214 when the first stiffening layer 212 and the second stiffening layer 214 are pulled apart, thereby increasing the R-value of the insulation batt 200. Expansion of the insulation batt 200 therefore can maximize the R-value of the insulation batt 200. Pulling the first stiffening layer 212 apart from the second stiffening layer 214 can optionally comprise pushing one or both of the first stiffening layer 212 and the second stiffening layer 214 away from each other in some aspects. Pulling the first stiffening layer 212 apart from the second stiffening layer 214 is also easier than fluffing typical standard insulation batts.

The first elongated connection panel 111 and the second elongated connection panel 113 can comprise a first connector 216. Likewise, the third elongated connection panel 115 and the fourth elongated connection panel 117 can comprise a second connector 218. The first connector 216 and the second connector 218 can couple the first stiffening layer 212 to the second stiffening layer 214. In the current aspect, the first connector 216 thus extends from a first lateral edge 222 of the first stiffening layer 212 to a first lateral edge 226 of the second stiffening layer 214, and the second connector 218 extends from a second lateral edge 224 of the first stiffening layer 212 to a second lateral edge 228 of the second stiffening layer 214. To transition the insulation batt 200 from the collapsed configuration to the expanded configuration, in the current aspect the first connector 216 and the second connector 218 can be pushed at the second lengthwise crease 118 and the fifth lengthwise crease 124 to bring the first elongated connection panel 111, the second elongated connection panel 113, the third elongated connection panel 115, and the fourth elongated connection panel 117 parallel to each other and orthogonal to the first stiffening layer 212 and the second stiffening layer 214. In the collapsed configuration of the current aspect, as shown in FIG. 3A, the first elongated connection panel 111 and the second elongated connection panel 113 are angled with respect to each other. Similarly, in the current aspect, the third elongated connection panel 115 and the fourth elongated connection panel 117 are angled with respect to each other in the collapsed configuration.

In the current aspect, the first stiffening layer 212, the second stiffening layer 214, and the connectors 216,218 can comprise corrugated cardboard and function to "stiffen" the shape of the insulation batt 200, preventing unwanted bending, folding, or collapsing of the insulation layer 202. In other aspects, the first stiffening layer 212, the second stiffening layer 214, and connectors 216 can comprise other rigid planar materials, such as foam board, rigid plastic sheets, such as vinyl, flashing, wood, such as particle board or oriented strand board, or any other rigid planar materials known in the art that are more rigid than, for example, sheet paper typically used in other insulation products to cover standard fiberglass insulation, which is typically insufficient to prevent unwanted bending, folding, or collapsing of the insulation layer 202.

The first stiffening layer 212, the second stiffening layer 214, and the connectors 216,218 can comprise a material, such as corrugated cardboard, that is capable of being cut, for example to customize the size of the insulation batt 200. In some aspects, the insulation batt 200 might be installed in an insulation cavity 500 (shown in FIG. 5) having dimensions smaller than the insulation batt 200, or might need to be installed in an insulation cavity 500 with a light switch, electrical outlet, or some other utility positioned in the insulation cavity 500, and cutting the insulation batt 200 to fit in the insulation cavity 500 might therefore be desired. In various aspects, one or both of the first stiffening layer 212 and the second stiffening layer 214 can comprise one or both of lengthwise and lateral spaced lines to provide guides to cut the insulation batt 200 with a straight lines. The lines, for example and without limitation, can be spaced apart at one inch intervals or at intervals of any other distance.

The insulation layer 202 can comprise fiberglass insulation or any other type of expandable and compressible insulation that can be coupled to the first stiffening layer 212 and the second stiffening layer 214. In various aspects, corrugated cardboard defines an approximately equal R-value to expanded fiberglass insulation, allowing the thickness of the cardboard to contribute equally to the R-value of the insulation batt 200 as a similar thickness of expanded fiberglass insulation. Additionally, in various aspects, the corrugated cardboard, or any other impervious material used for the first stiffening layer 212, the second stiffening layer 214, and the connectors 216,218, can serve to contain the fiberglass and fiberglass dust of the insulation layer 202.

Figure 3B:
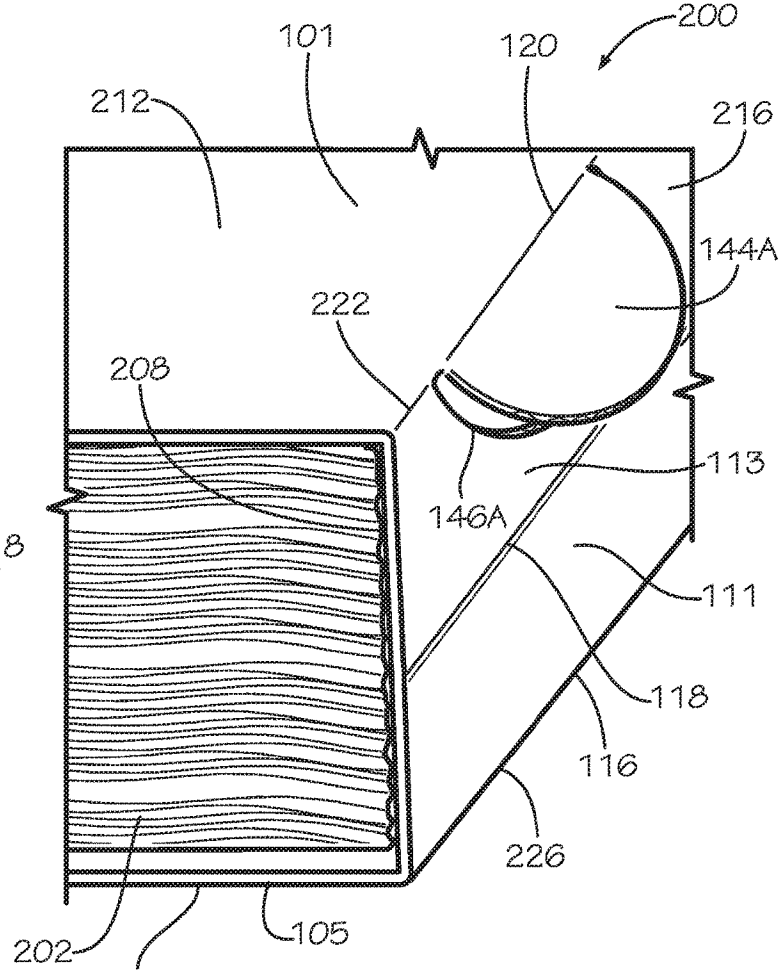
FIG. 3B is an enlarged perspective view of one end of the insulation batt of FIG. 2 in the expanded configuration.
Figure 3A:
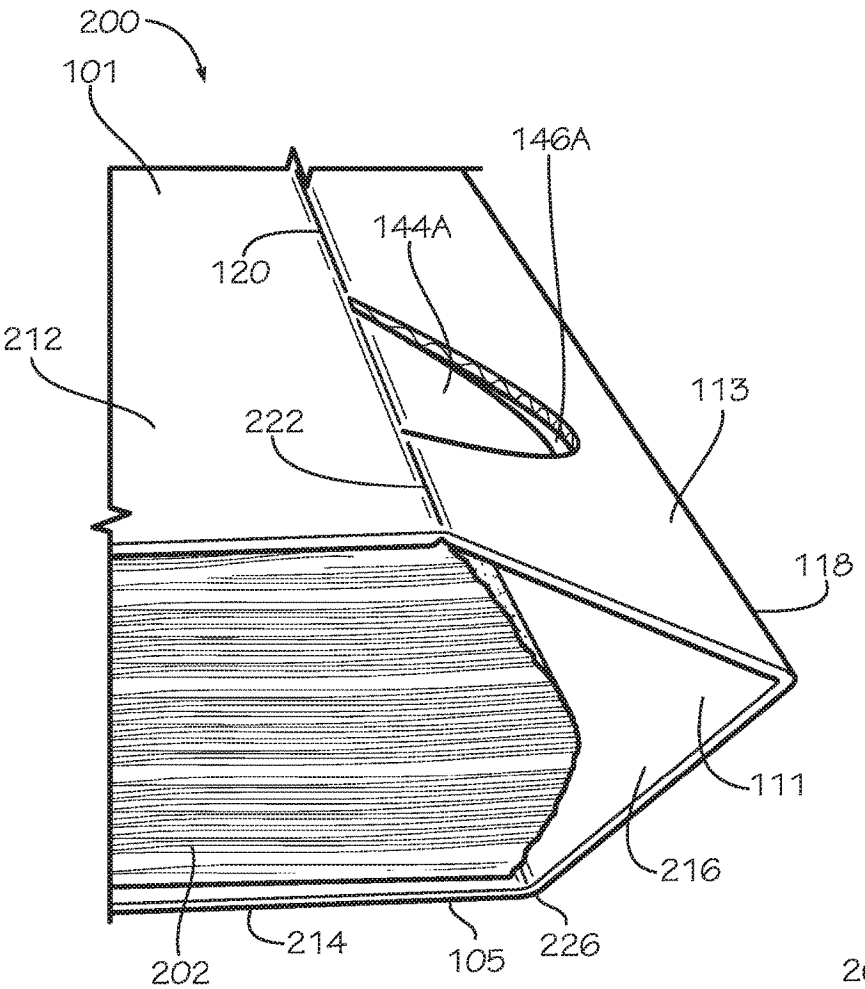
FIG. 3A is an enlarged perspective view of one end of the insulation batt of FIG. 2 in a collapsed configuration.

Further, as shown in FIGS. 2 and 3B, in the expanded configuration, the first elongated connection panel 111, the second elongated connection panel 113, the third elongated connection panel 115, and the fourth elongated connection panel 117 can be positioned substantially parallel to each other and orthogonal to the first stiffening layer 212 and the second stiffening layer 214. The first elongated connection panel 111 and the second elongated connection panel 113 can thereby abut the first lateral edge 208 of the insulation layer 202, and the third elongated connection panel 115 and the fourth elongated connection panel 117 thereby abut the second lateral edge 210 of the insulation layer 202.

Further, as shown in FIGS. 2 and 3B, in the expanded configuration, the mounting tabs 144A-H stand out from the second elongated connection panel 113. Similarly, the mounting tabs 144I-P stand out from the third elongated connection panel 115 in the expanded configuration. Therefore the mounting tabs 144 are not parallel to the elongated connection panels 111, 113, 115, 117 in the expanded configuration, but instead are angled with respect to the first elongated connection panel 111 and the second elongated connection panel 115, respectively. The mounting tabs 144 can be parallel to the first stiffening layer 212 in some aspects in the expanded configuration.

FIG. 3A shows an enlarged perspective view of an end of the insulation batt 200 proximate to the first connector 216 in a collapsed configuration. In the collapsed configuration, the first stiffening layer 212 and the second stiffening layer 214 are brought closer together, thereby compressing the insulation layer 202. The first connector 216 and the second connector 218 can additionally be folded in some aspects. In the current aspect, the first elongated connection panel 111 and the second elongated connection 113 can fold at the second lengthwise crease 118 relative to each other, and the insulation layer 202 can expand into a space between the first elongated connection panel 111 and the second elongated connection panel 113. Similarly, the third elongated connection panel 115 and the fourth elongated connection panel 117 can fold at the fifth lengthwise crease 124 relative to each other, and the insulation layer 202 can expand into a space between the between the third elongated connection panel 115 and the fourth elongated connection panel.

The mounting tabs 144, in the collapsed configuration, can, in one aspect, nest into the slots 146, as shown in FIG. 3A. In other aspects, the mounting tabs 144 can become parallel with the respective elongated connection panels 113, 115, or can remain parallel with the first stiffening layer 212 or at any angle therebetween the first stiffening layer 212 and the respective elongated connection panels 113, 115.

As shown in FIG. 2, the lateral crease 114 of the blank 100 can extend all the way around the insulation batt 200 once the insulation batt 200 in assembled. In some aspects, the lateral crease 114 can allow for folding of the insulation batt 200 when the insulation batt 200 is in the collapsed configuration. Additionally, in some aspects, a portion or all of the lateral crease 114 can be perforated or cut to assist in folding of the insulation batt 200. The insulation layer 202 can also be similarly cut adjacent to the lateral crease 114 to assist in folding of the insulation batt 200. In some aspects, for example and without limitation, the lateral crease 114 can be perforated between the first lengthwise crease 116 and the sixth lengthwise crease 126, thereby allowing the lateral crease 114 to be torn all along the perforated portion and thus allowing the insulation batt 200 to fold along those portions of the lateral crease 114 on the first back panel 105 and the second back panel 109 forming the second stiffening layer 214. In other aspects, the lateral crease 114 can be perforated from the third lengthwise crease 120 to the left edge 132 of the blank 100 and from the fourth lengthwise crease 122 to the right edge 134 of the blank 100, thereby allowing the lateral crease 114 to be torn along these two portions of the lateral crease 114 and thus allowing the insulation batt 200 to fold along the portion of the lateral crease 114 of the first panel 101 forming the first stiffening layer 212.

Additionally, the insulation batt 200 can have any number of lateral creases 114 with or without perforated portions to allow for multiple folds in the insulation batt 200. For example and without limitation, the insulation batt 200 can have two lateral creases 114 spaced evenly on the insulation batt 200 and with alternating perforated portions such that one lateral crease 114 can fold on the first stiffening layer 212 and the other lateral crease 114 can fold on the second stiffening layer 214, allowing the insulation batt 200 to be folded in an accordion-shaped configuration. See, for example, step 805 in FIG. 12.

Figure 4:
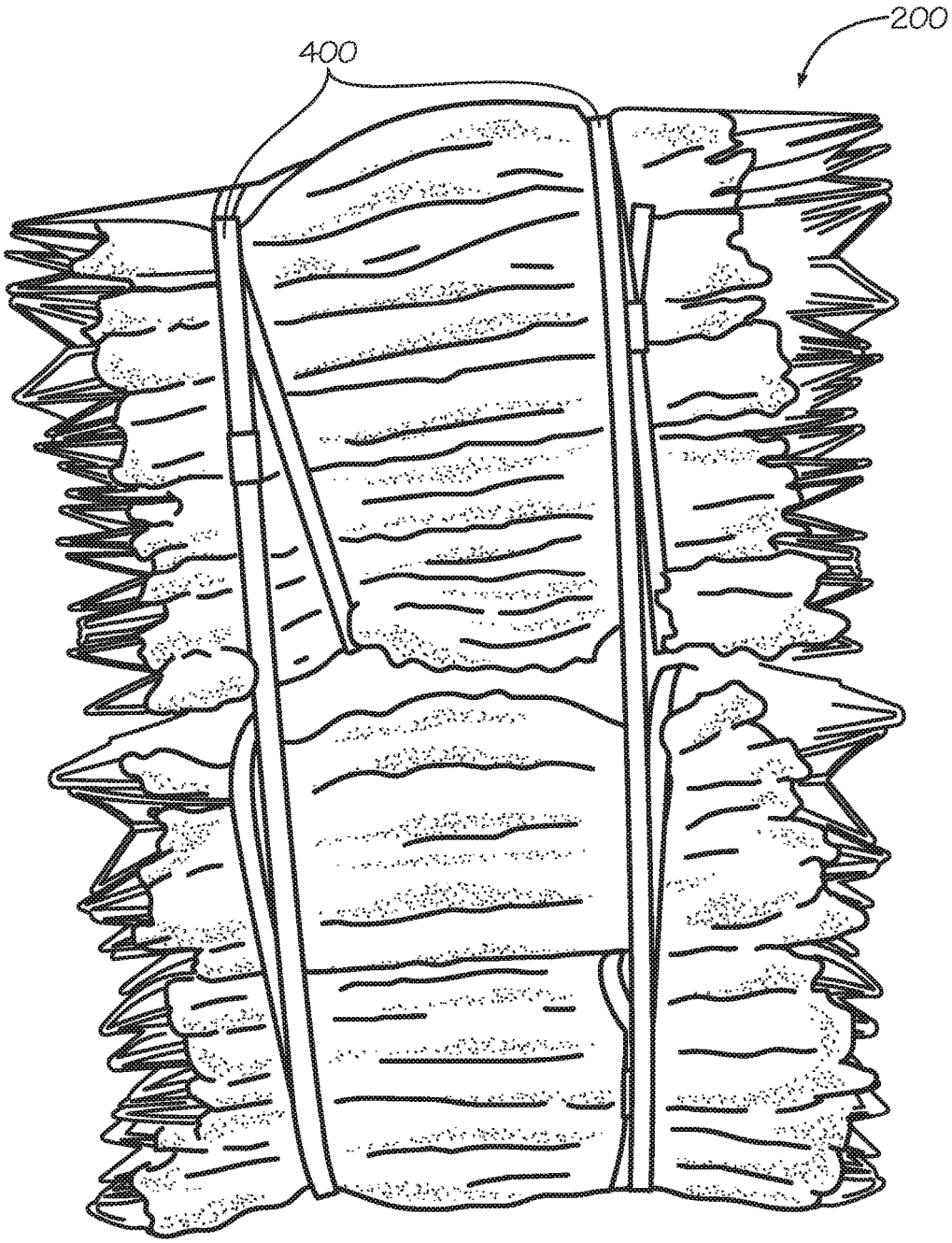
FIG. 4 is a side view of a plurality of the insulation batts of FIG. 2 in a collapsed and stacked configuration.

FIG. 4 shows a stack of insulation batts 200, each in the collapsed configuration, thereby illustrating the ease of shipping insulation batts 200. The insulation batts 200 can be bundled with straps 400, for instance, or placed within larger boxes or other storage containers. The collapsed configuration increases the number of insulation batts 200 that can be shipped between locations, such as from a manufacturing facility to a retailer, for instance. The insulations batts 200 can therefore be efficiently transported in the collapsed configuration, including to the site of installation of the insulation batts 200, and the insulation batts can thereafter be placed into the expanded configuration to maximize the insulation batts' R-value upon installation into a house or other location requiring insulation.

Figure 5:
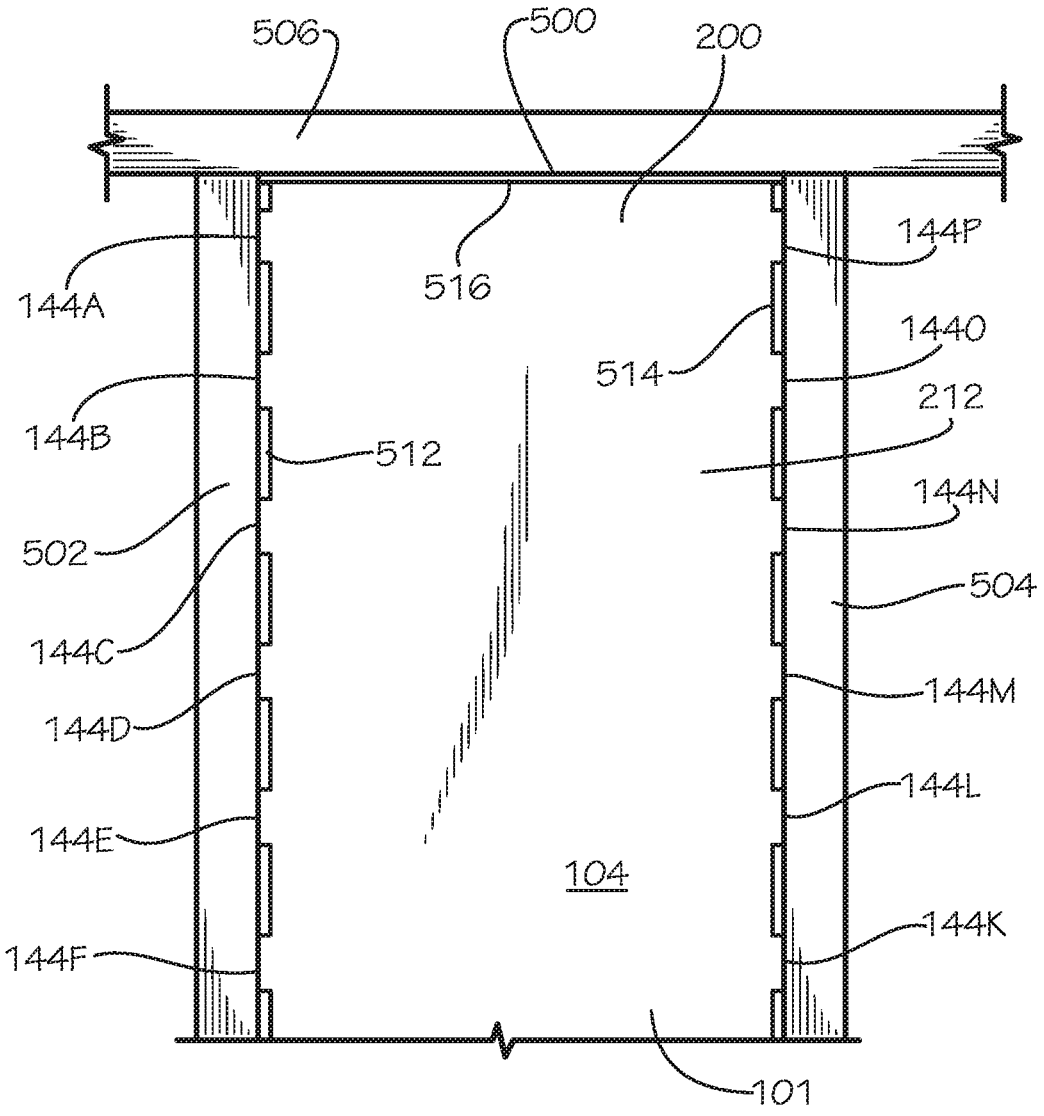
FIG. 5 is a front view of the insulation batt of FIG. 2 in the expanded configuration shown installed in an insulation cavity.

FIG. 5 shows the insulation batt 200 installed in the insulation cavity 500 from a front side of the insulation cavity 500. The insulation batt 200 can be installed into the insulation cavity 500 in the expanded configuration in the current aspect. As shown in FIG. 5, the insulation batt 200 can be installed with the first stiffening layer 212 facing outward such that the outer surface 104 of the front panel 101 faces a front side of the insulation cavity 500. In the current aspect, the insulation cavity 500 is defined by two-by-fours, including a left two-by-four 502, a right two-by-four 504, an upper two-by-four 506, and a lower two-by-four (not shown). The insulation batt 200 can be sized such that, when placed in the insulation cavity 500, the insulation batt 200 fills the insulation cavity 500 except for a left clearance gap 512 between the insulation batt 200 and the left two-by-four 502, a right clearance gap 514 between the insulation batt 200 and the right two-by-four 504, and an upper clearance gap 516 between the insulation batt 200 and the upper two-by-four 506. In the current aspect, each clearance gap 512, 514, 516 measures about 0.0625 (1/16) to 0.125 (1/8) inches wide, though other aspects can comprise clearance gaps having different widths, or the insulation batt 200 can be positioned flush against any or all of the two-by-fours 502, 504, 506 in other aspects. The insulation batt 200 can also be placed flush on top of the lower two-by-four or can likewise be slightly spaced from the lower two-by-four to define another clearance gap.

Additionally, the insulation batt 200 can be sized to fit fully into one insulation cavity 500, or the insulation batt 200 can be sized such that multiple insulation batts 200 can fit into one insulation cavity 500.

FIG. 5 also shows one aspect of the mounting tabs 144 holding the insulation batt 200 in place within the insulation cavity 500. The mounting tabs 144 can extend outward from the first stiffening layer 202 of the insulation batt 200 such that the mounting tabs 144 are biased against either or both of the left two-by-four 502 and the right two-by-four 504 proximate to the front side of the insulation cavity 500. The mounting tabs 144 thereby hold the insulation batt 200 in the insulation cavity 500, allowing drywall or other building materials to be installed over and around the insulation batt 200 to enclose the insulation cavity 500. In other aspects, the insulation batt can be installed with the first stiffening layer 212 facing a back side of the insulation cavity 500 such that the mounting tabs 144 are biased against the left two-by-four 502 and the right two-by-four 504 proximate to the back side of the insulation cavity 500.

Figure 6:
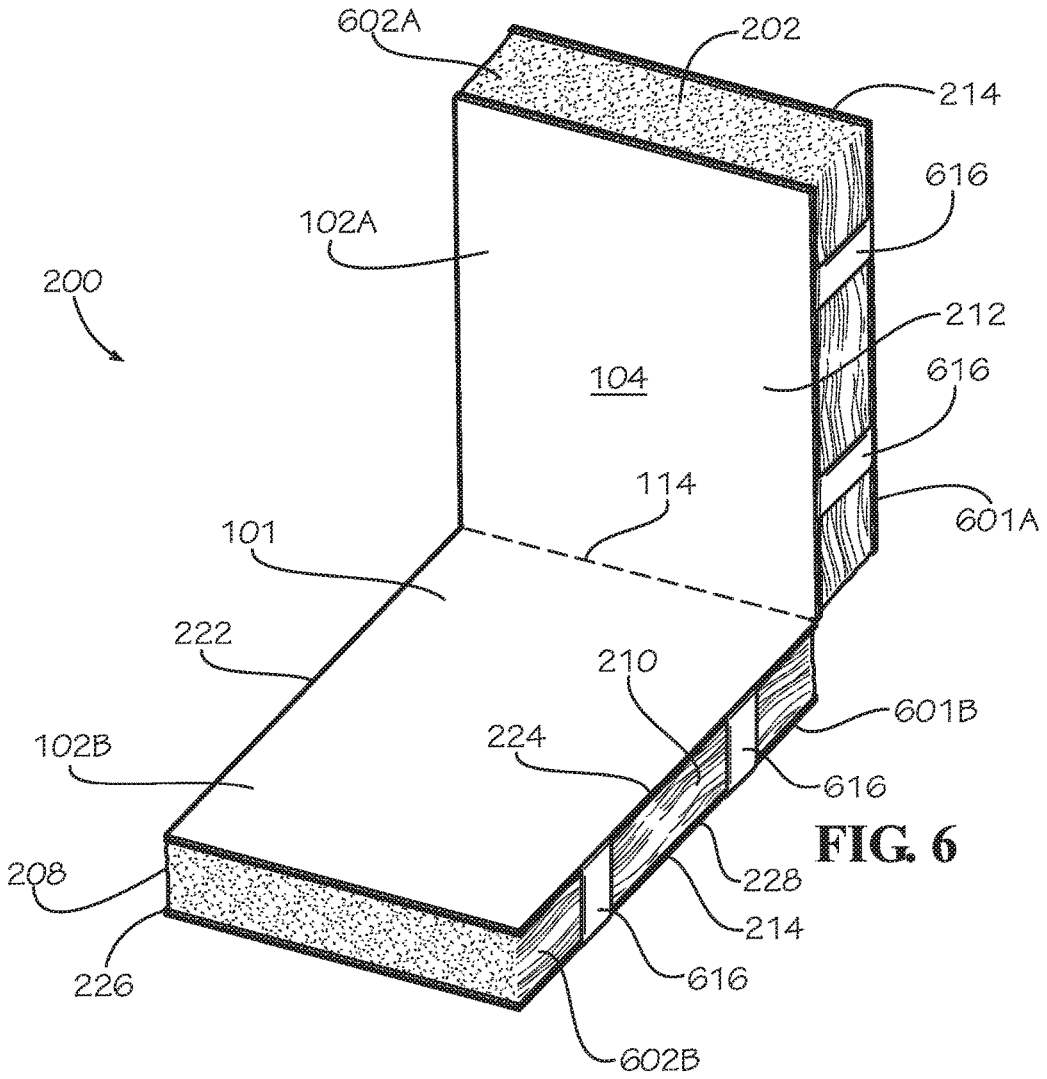
FIG. 6 is a perspective view of an insulation batt in accordance with another aspect of the current disclosure in an expanded and partially folded configuration.

FIG. 6 shows another aspect of an insulation batt 200. As shown in FIG. 6, the insulation batt 200 can comprise the front panel 101 with the lateral crease 114 across the front panel 101. The front panel 101 forms the first stiffening layer 212 and can be coupled to the insulation layer 202. The insulation layer 202 can comprise an upper portion 602A and a lower portion 602B, with the upper portion 602A coupled to the upper portion 102A of the front panel 101 and the lower portion 602B coupled to the lower portion 102B of the front panel 101. The second stiffening layer 214 can comprise an upper portion 601A and a lower portion 601B, with the upper portion 601A of the second stiffening layer 214 coupled to the upper portion 602A of the insulation layer 202 and the lower portion 601B of the second stiffening layer 214 coupled to the lower portion 602B of the insulation layer 202.

As shown in FIG. 6, the insulation batt 200 can be folded along the lateral crease 114. The second stiffening layer 214 can, in some aspects, comprise a similar crease between the upper portion 601A and the lower portion 601B that can be perforated to allow separation of the upper portion 601A and the lower portion 601B and folding of the insulation batt 200 along the lateral crease 114. The insulation layer 202 can also optionally be precut between the upper portion 602A and the lower portion 602B to allow folding of the insulation batt 200.

Figure 7:
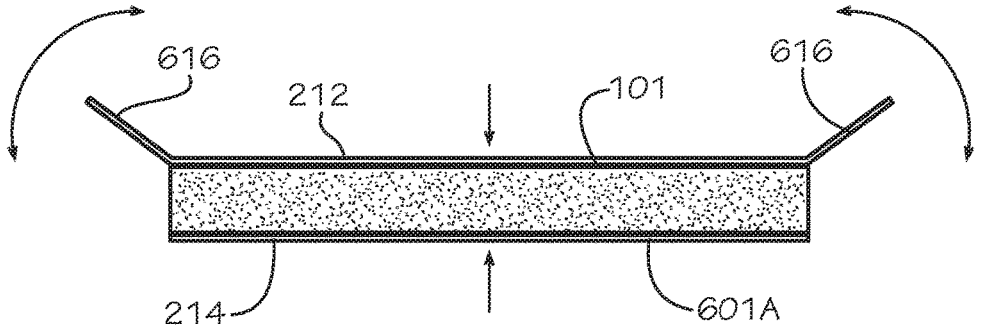
FIG. 7 is an end view of the insulation batt of FIG. 6.

The insulation batt 200 of FIG. 6 can comprise connectors coupling the first stiffening layer 212 and the second stiffening layer 214 in the expanded configuration in the form of a plurality of levers 616 extending from the first lateral edge 222 of the first stiffening layer 212 to the first lateral edge 226 of the second stiffening layer 214. The connectors can additionally comprise additional levers 616 extending from the second lateral edge 224 of the first stiffening layer 212 to the second lateral edge 228 of the second stiffening layer 214. Each lever 616 can be integral with or attached to the first stiffening layer 212, such as with tape or adhesive. Each lever 616 can be coupled to the second stiffening layer 214 by being braced against the second stiffening layer 214 to hold the first stiffening layer 212 apart from the second stiffening layer 214 to maintain the insulation batt 200 in the expanded configuration. In other aspects, each lever 616 can be coupled to the second stiffening layer 214 by being integral with or attached to the second stiffening layer 214, such as with tape or adhesive. As shown in FIG. 7, in some aspects, each lever 616 can be detached from the second stiffening layer 214 and can be folded upward and around the first stiffening layer 212 to allow the insulation batt 200 to be compressed to the collapsed configuration. In some aspects, the connectors 216,218 can comprise both elongated panels 111, 113, 115, 117 and lever arms 616 alternating lengthwise along the lateral edges 208,210 of the insulation layer 202.

Figure 8:
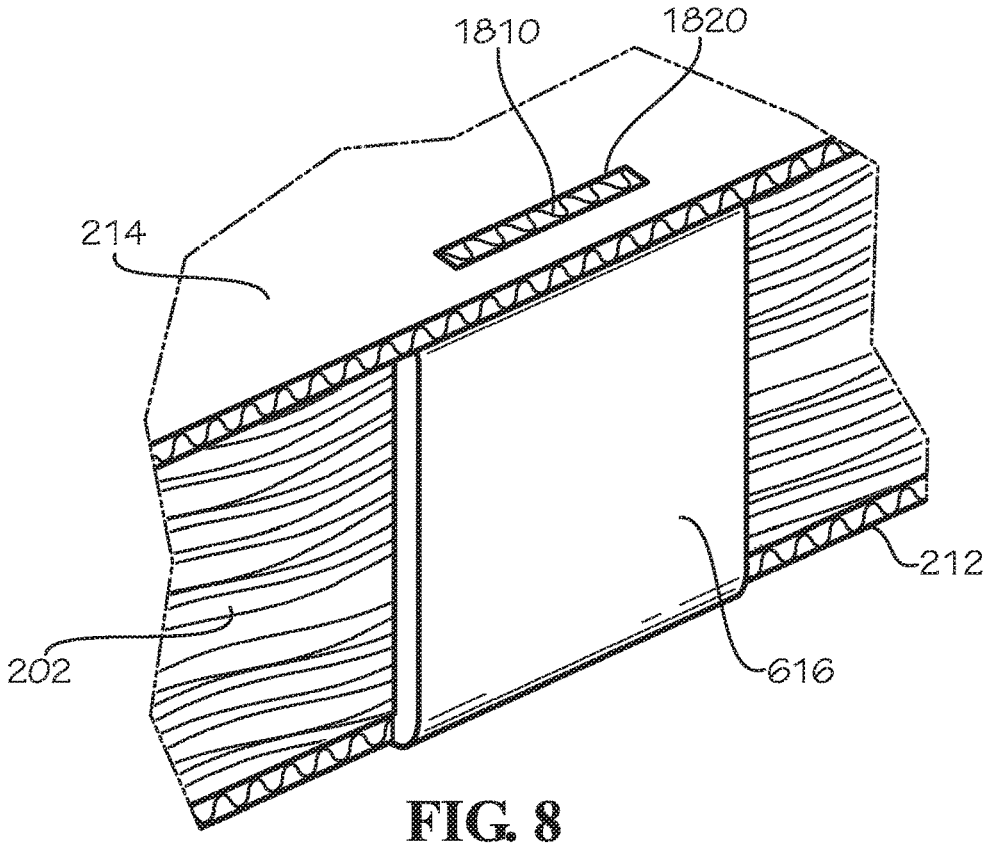
FIG. 8 is an enlarged perspective view of a lever arm on an insulation batt in accordance with another aspect of the current disclosure with the insulation batt in an expanded configuration.
Figure 9:
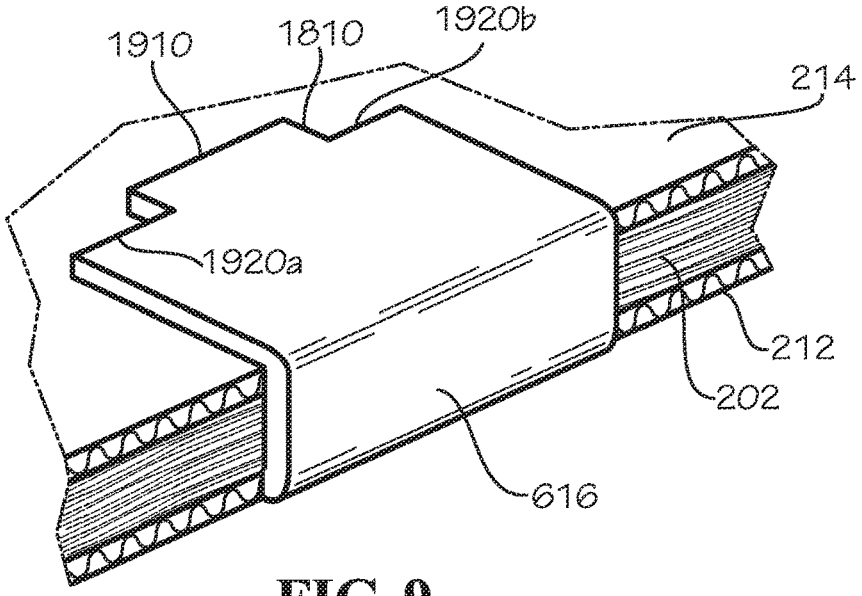
FIG. 9 is an enlarged perspective view of the lever arm on the insulation batt of FIG. 8 with the insulation batt in a collapsed configuration.

FIGS. 8 and 9 show another aspect of a lever arm 616 on an insulation batt 200. As shown in FIG. 8, the lever arm 616 is integral with the first stiffening layer 212 and, when the insulation batt 200 is in the expanded configuration, a tab 1810 defined on a distal end 1910 (shown in FIG. 9) of the lever arm 616 can be inserted into a complementary slot 1820 defined through the second stiffening layer 214. The slot 1820 thereby holds the lever arm 616 in place to maintain the insulation batt 200 in the expanded configuration. The tab 1810 can thereby define a pair of shoulders 1920*a,b* (shown in FIG. 9) in the distal end 1910 of the lever arm 616. As shown in FIG. 9, when the insulation batt 200 is in the collapsed configuration, the lever arm 616 can be folded over the second stiffening layer 214. The lever arm 616 can optionally thereafter be taped or adhered to the second stiffening layer 214 or otherwise coupled to the second stiffening layer 214 to hold the lever arm 616 in place or to maintain the insulation batt 200 in the collapsed configuration for transport or storage.

Figure 10:
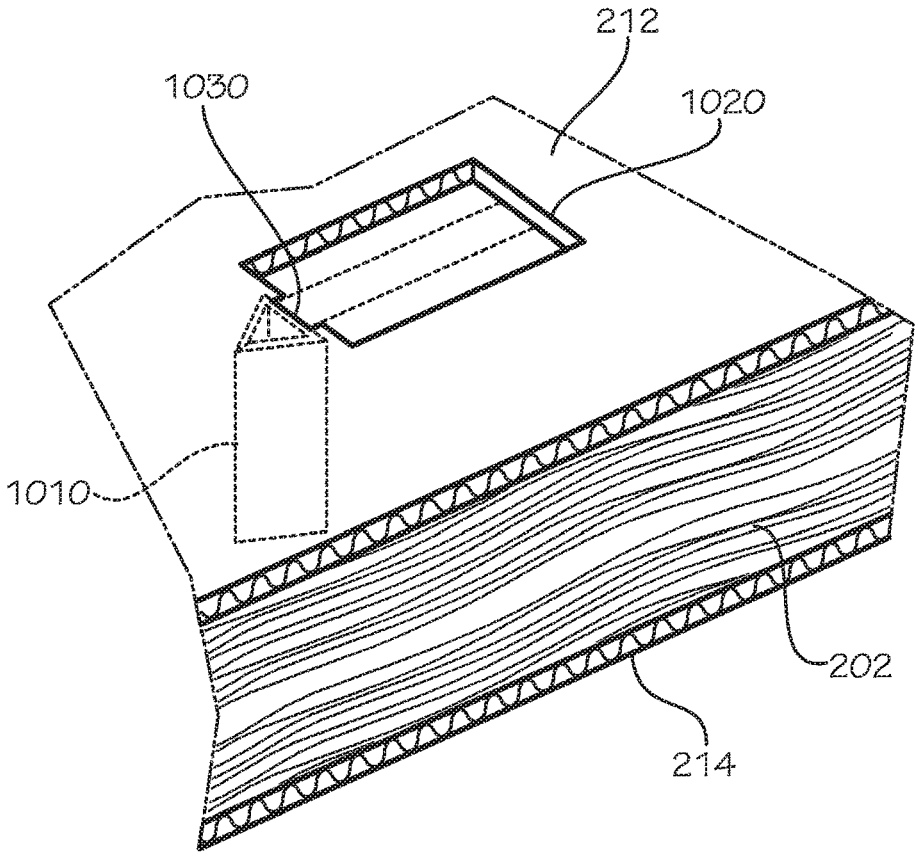
FIG. 10 is an enlarged perspective view of a lever arm on an insulation batt in accordance with another aspect of the current disclosure with the insulation batt in an expanded configuration.
Figure 11:
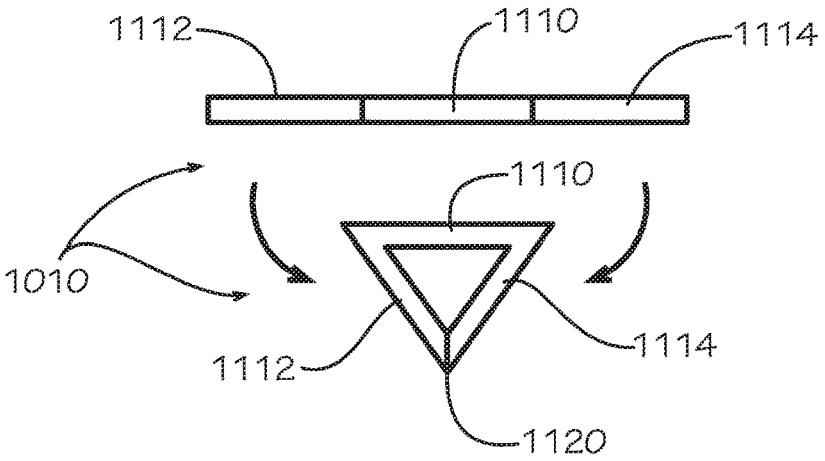
FIG. 11 is an end view of the lever arm of FIG. 10 showing the lever arm in a flat configuration and a folded configuration.

FIG. 10 shows another aspect of an insulation batt 200 utilizing an inboard lever arm 1010 to maintain the insulation batt 200 in the expanded configuration. The inboard lever arm 1010 can be defined by an arm cutout 1020 defined through the first stiffening layer 212. The inboard lever arm 1010 can be integral with the first stiffening layer 212 at a hinge 1030 and can be braced against the second stiffening layer 214 to hold the first stiffening layer 212 and the second stiffening layer 214 apart to maintain the insulation batt 200 in the expanded configuration. FIG. 11 shows the inboard lever arm 1010 in a flat configuration and a folded configuration. The inboard lever arm 1010 can comprise a central panel 1110, a first wing panel 1112, and a second wing panel 1114. The first wing panel 1112 and the second wing panel 1114 are distal to each other on opposite edges of the central panel 1110 in the flat configuration. The central panel 1110 is attached to the first stiffening layer 212 at the hinge 1030.

To assemble the inboard lever arm 1010 in the current aspect, each of the first wing panel 1112 and the second wing panel 1114 can be folded downward relative to the central panel 1110. The central panel 1110 can optionally be rotated away from the first stiffening layer 212 and the insulation layer 202 on the hinge 1030 to allow folding of the first wing panel 1112 and the second wing panel 1114. The first wing panel 1112 and the second wing panel 1114 are folded towards each other underneath the central panel 1110 until the first wing panel 1112 and the second wing panel 1114 contact so that the inboard lever arm 1010 forms a triangular cross-section that defines a lower edge 1120. The lower edge 1120 can facilitate the inboard lever arm 1010 being pushed through the insulation layer 202 about the hinge 1030 to brace the inboard lever arm 1010 against the second stiffening layer 214. In various aspects, the first wing panel 1112 and the second wing panel 1114 can be coupled to each, for example and without limitation, with tape, adhesive, fasteners, or clips, or can be folded towards each other without any fastening mechanism. The inboard lever arm 1010 provides support to maintain the insulation batt 200 in the expanded configuration, and can be additionally beneficial on insulation batts 200 that are wider than typical or where an insulation panel 200 must be cut on one side to fit within the insulation cavity 500. The inboard lever arm 1010 can be used in combination with or in place of the level arms 616 or the elongated connection panels 111, 113, 115, 117. The inboard lever arm 1010 can be diecut and can be defined with a perforated line or can be fully precut so that no perforations need be cut.

Figure 12:
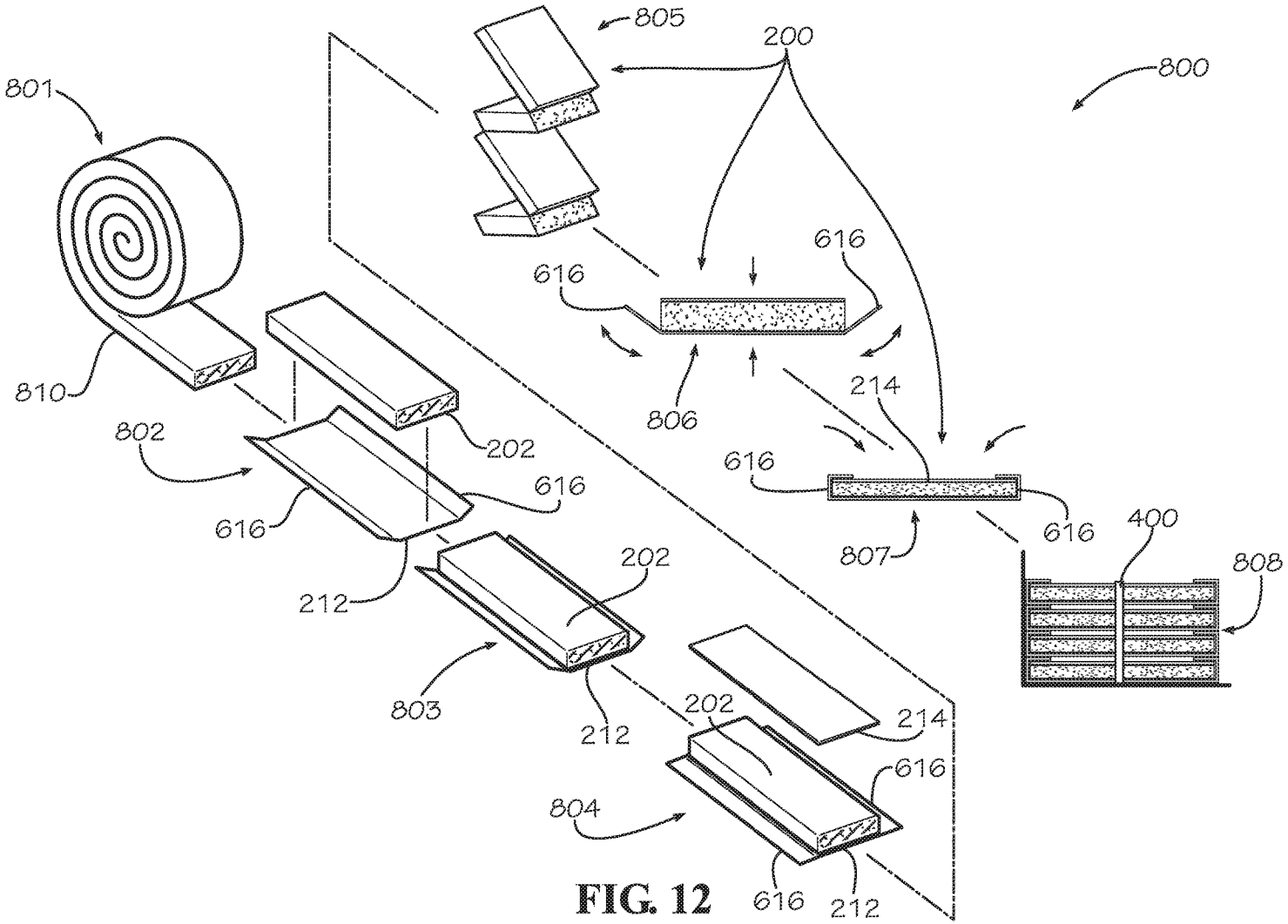
FIG. 12 is a process diagram for constructing an insulation batt in accordance with another aspect of the current disclosure.

FIG. 12 shows a process 800 for manufacturing an insulation batt 200 similar to the insulation batt of FIG. 6, except with levers 616 extending the length of the first stiffening layer 212 instead of spaced intermittently along each side of the insulation layer 202. Step 801 of the process 800 comprises unrolling a roll of insulation 810. Step 802 comprises cutting a portion of the roll of insulation 810 to form the insulation layer 202 and placing the insulation layer 202 over the first stiffening layer 212. Step 803 comprises coupling the insulation layer 202 to the first stiffening layer 212, and step 804 comprises placing the insulation layer 202 under the second stiffening layer 214, after which the levers 616 are folded up to couple to the second stiffening layer 214. In step 805, the insulation batt 200 is cut and folded into an accordion shape. In step 806, the levers can be decoupled from the second stiffening layer 214, and in step 807, the insulation batt 200 can be compressed into the collapsed configuration, either in the accordion shape or in a fully extended configuration, and the levers 616 can be folded over the second stiffening layer 214. Finally, in step 808, the insulation batt 200 can be stacked and bond with straps 400. In another aspect, the insulation batt of FIG. 2 can be similarly assembled, with the first back panel 105 and the second back panel 109 folded around the insulation layer 202 in step 804 to couple the first back panel 105 and the second back panel 109 to each other to form the second stiffening layer 212 and then couple the second stiffening layer 212 to the insulation layer 202.

Figure 13:
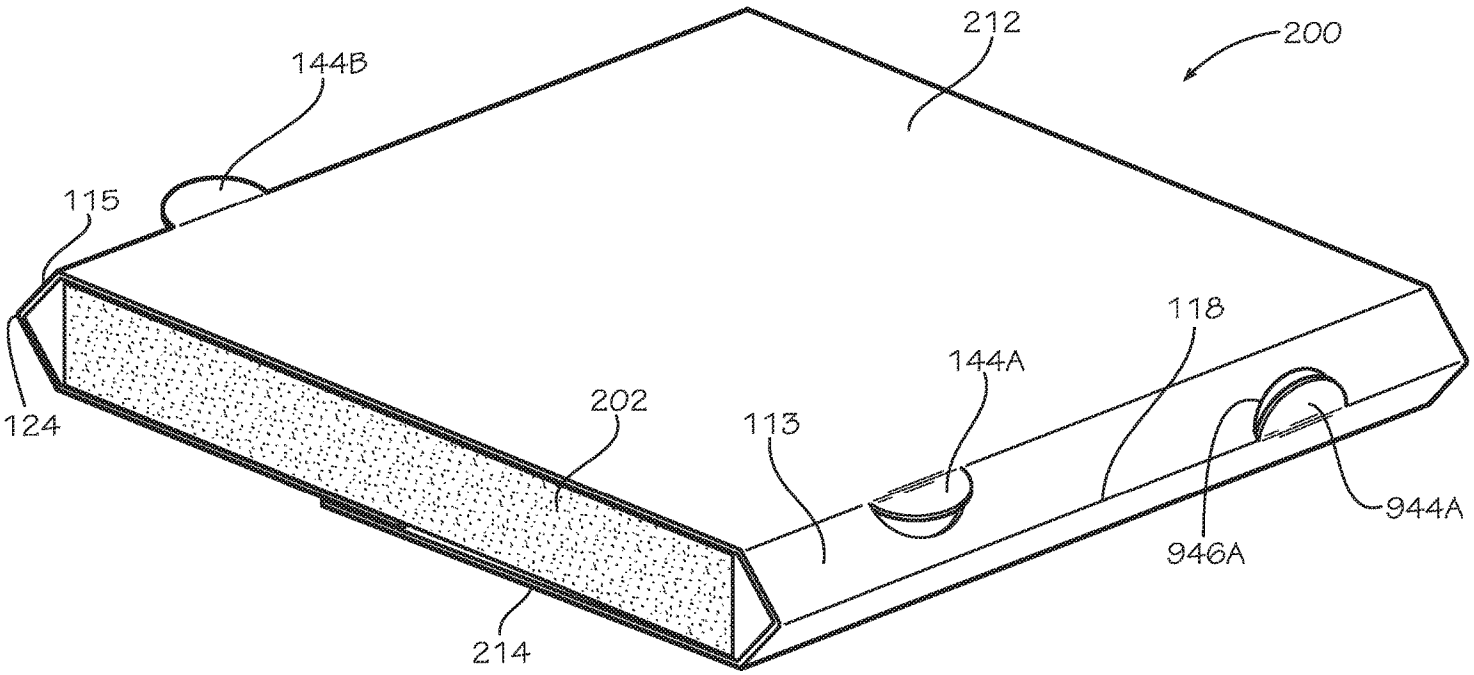
FIG. 13 is a perspective view of an insulation batt in accordance with another aspect of the current disclosure in a partially collapsed configuration.
Figure 14:
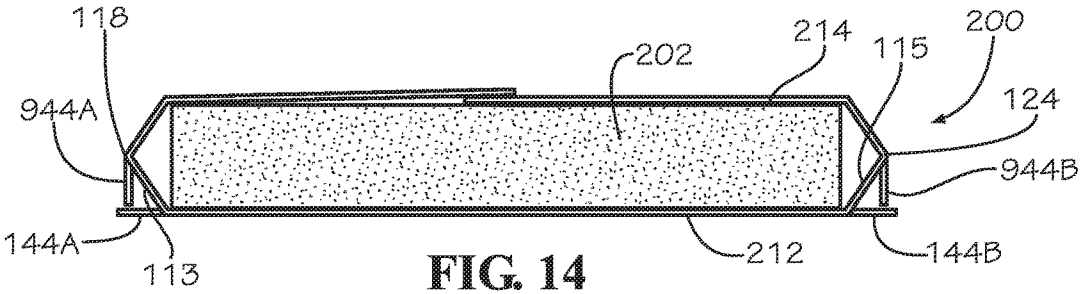
FIG. 14 is an end view of the insulation batt of FIG. 13.

FIGS. 13 and 14 show another aspect of the insulation batt 200. The insulation batt 200 of FIGS. 13 and 14 comprise mounting tabs 144A and 144B similar to mounting tabs 144A-B of FIG. 1. The insulation batt 200 of FIGS. 13 and 14 also comprises mounting tabs 944A-B formed by slots 946A-B (946B not shown). In the current aspect, the mounting tabs 944A-B can extend in an opposite direction from the mounting tabs 144 on each of the second elongated connection panel 113 and the third elongated connection panel 115. When installed in the insulation cavity 500, the opposing directions of the mounting tabs 144 and 944 provide additional biasing to hold the insulation batt 200 in the insulation cavity 500. The slots 946A-B are formed in the second elongated connection panel 113 and the third elongated connection panel 115, respectively. In the current aspect, each end of each slot 946A-B (946B not shown) terminates at the second lengthwise crease 118 and the fifth lengthwise crease 124, respectively, such that the mounting tab 944A is defined on the second elongated connection panel 113 along the second lengthwise crease 118 and the mounting tab 944B is defined on the third elongated connection panel 115 along the fifth lengthwise crease 124. In various aspects, the insulation batt 200 can define any number of mounting tabs 144,944 in any desired pattern, such as alternating the mounting tabs 144,944 or including less mounting tabs 944 or more mounting tabs 944 than mounting tabs 144. In various aspects, the mounting tabs 944 can function as friction tabs to hold against the left two-by-four 502 and the right two-by-four 504, and the mounting tabs 144 can function as registration tabs to contact fronts of the two-by-fours 502,504 to indicate that the insulation batt 200 is full inserted into the insulation cavity 500. Additionally, in various aspects with or without the mounting tabs 944, the mounting tabs 144 can contact the fronts of the two-by-fours 502,504 and thereafter be nailed, stapled, taped, glued, or otherwise coupled to the fronts of the two-by-fours 502,504 to hold the insulation batt 200 within the insulation cavity 500.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of installing an insulation batt comprising:

expanding an insulation layer of insulation batt between a first stiffening layer and a second stiffening layer of the insulation batt;

placing the insulation batt in an insulation cavity;

folding a mounting tab outwards from a slot and away from a connector, the mounting tab attached to one of the first stiffening layer and the second stiffening layer, the mounting tab securing the insulation batt within the insulation cavity, the slot defined in the connector, the connector coupling the first stiffening layer to the second stiffening layer; and engaging the mounting tab to a two-by-four of the insulation cavity.

2. The method of claim 1, wherein the connector comprises a first elongated connection panel and a second elongated connection panel, and wherein expanding the insulation layer comprises folding the first elongated connection panel relative to the first stiffening layer and folding the second elongated connection panel relative to the second stiffening layer.

3. The method of claim 1, wherein the mounting tab is a first mounting tab, and wherein the method further comprises engaging a second mounting tab of the insulation batt with a wall of the insulation cavity to position the insulation batt in the insulation cavity.

4. The method of claim 2, wherein expanding the insulation layer comprises positioning the first elongated connection panel and the second elongated connection panel in parallel and coplanar alignment.

5. The method of claim 2, wherein the connector defines a lengthwise crease between the first elongated connection panel and the second elongated connection panel, and wherein expanding the insulation layer further comprises pressing the lengthwise crease inwards towards the insulation layer to pull the first stiffening layer apart from the second stiffening layer.

6. The method of claim 1, further comprising coupling the mounting tab to the two-by-four.

7. The method of claim 1, wherein expanding the insulation layer comprises pulling the first stiffening layer apart from the second stiffening layer, the insulation layer coupled to each of the first stiffening layer and the second stiffening layer.

8. The method of claim 7, wherein expanding the insulation layer further comprises holding the first stiffening layer apart from the second stiffening layer.

9. The method of claim 8, wherein holding the first stiffening layer apart from the second stiffening layer comprises:

folding a lever relative to the first stiffening layer, the lever coupled to the first stiffening layer, the lever defining a distal end disposed opposite from the first stiffening layer; and engaging the distal end of the lever with the second stiffening layer.

10. The method of claim 9, wherein holding the first stiffening layer apart from the second stiffening layer further comprises engaging a tab with a slot, the tab defined on the distal end of the lever, the slot defined by the second stiffening layer.

11. The method of claim 8, wherein holding the first stiffening layer apart from the second stiffening layer comprises folding an inboard lever arm of the first stiffening layer inwards towards the second stiffening layer and engaging the inboard lever arm with the second stiffening layer.

12. A method of installing an insulation batt comprising:

expanding an insulation layer of insulation batt between a first stiffening layer and a second stiffening layer of the insulation batt, expanding the insulation layer comprising:

pulling the first stiffening layer apart from the second stiffening layer, the insulation layer coupled to each of the first stiffening layer and the second stiffening layer; and holding the first stiffening layer apart from the second stiffening layer comprising:

folding a lever relative to the first stiffening layer, the lever coupled to the first stiffening layer, the lever defining a distal end disposed opposite from the first stiffening layer; and engaging the distal end of the lever with the second stiffening layer; and placing the insulation batt in an insulation cavity.

13. The method of claim 12, wherein a connector couples the first stiffening layer to the second stiffening layer.

14. The method of claim 13, wherein the connector comprises a first elongated connection panel and a second elongated connection panel, and wherein expanding the insulation layer comprises folding the first elongated connection panel relative to the first stiffening layer and folding the second elongated connection panel relative to the second stiffening layer.

15. The method of claim 12, further comprising engaging a mounting tab of the insulation batt with a wall of the insulation cavity to position the insulation batt in the insulation cavity.

16. The method of claim 12, wherein holding the first stiffening layer apart from the second stiffening layer further comprises engaging a tab with a slot, the tab defined on the distal end of the lever, the slot defined by the second stiffening layer.

17. A method of installing an insulation batt comprising:

expanding an insulation layer of insulation batt between a first stiffening layer and a second stiffening layer of the insulation batt, expanding the insulation layer comprising:

pulling the first stiffening layer apart from the second stiffening layer, the insulation layer coupled to each of the first stiffening layer and the second stiffening layer; and holding the first stiffening layer apart from the second stiffening layer comprising:

folding an inboard lever arm of the first stiffening layer inwards towards the second stiffening layer; and engaging the inboard lever arm with the second stiffening layer; and placing the insulation batt in an insulation cavity.

18. The method of claim 17, wherein a connector couples the first stiffening layer to the second stiffening layer.

19. The method of claim 18, wherein the connector comprises a first elongated connection panel and a second elongated connection panel, and wherein expanding the insulation layer comprises folding the first elongated connection panel relative to the first stiffening layer and folding the second elongated connection panel relative to the second stiffening layer.

20. The method of claim 17, further comprising engaging a mounting tab of the insulation batt with a wall of the insulation cavity to position the insulation batt in the insulation cavity.

* * * * *